United States Patent [19]

Kelly

[11] Patent Number: 4,848,590

[45] Date of Patent: Jul. 18, 1989

[54] APPARATUS FOR THE MULTISORTING OF SCRAP METALS BY X-RAY ANALYSIS

[75] Inventor: Leonard Kelly, Peterborough, Canada

[73] Assignees: Helen M. Lamb; Moira F. Kelly, both of Ontario, Canada

[21] Appl. No.: 29,181

[22] Filed: Mar. 23, 1987

[30] Foreign Application Priority Data

Apr. 24, 1986 [CA] Canada ..... 507506

[51] Int. Cl.[4] ..... B07C 5/00

[52] U.S. Cl. ..... 209/564; 198/372; 209/589; 209/639; 209/911

[58] Field of Search ..... 209/563, 564, 576, 577, 209/587, 589, 586, 639, 644, 911; 378/45; 250/359.1; 198/367, 372; 193/31 A, 31 R

[56] References Cited

U.S. PATENT DOCUMENTS

| | | | |
|---|---|---|---|
| 3,011,634 | 12/1961 | Hutter et al. | 209/589 X |
| 3,472,375 | 10/1969 | Mathews | 209/589 X |
| 3,655,964 | 4/1972 | Slight | 209/589 X |
| 3,901,388 | 8/1975 | Kelly | 209/587 |
| 4,317,521 | 3/1982 | Clark et al. | 209/589 X |
| 4,365,719 | 12/1982 | Kelly | 209/589 |
| 4,388,994 | 6/1983 | Suda et al. | 209/564 |

*Primary Examiner*—Robert B. Reeves
*Assistant Examiner*—Donald T. Hajec
*Attorney, Agent, or Firm*—James H. Beusse

[57] ABSTRACT

Apparatus for sorting pieces of non-ferrous scrap metal into a plurality of components, each component being a particular metal type, feeds the pieces into a vertically disposed sorting zone. The pieces fall down a steeply inclined guide member under the influence of gravity and they pass a pair of timing devices which are spaced apart along the guide member, each timing device being a light source on one side of the path of the pieces and a light detector on the other side. The timing devices provide signals representing not only timing but also size an velocity. The pieces then pass an x-ray analysis system including a source of high energy rays to induce x-ray fluorescence and a detector to detect this fluorescence. The detector provides signals indicating the metal type for each piece of scrap. The pieces then fall past a plurality of blast nozzles spaced apart along the guide member. Each nozzle has a control which turns on a flow of fluid such as air through the nozzle to deflect a particular piece into a specific deflection path. Each piece is thus directed into a deflection path for a specific component.

8 Claims, 3 Drawing Sheets

APPARATUS FOR THE MULTISORTING OF SCRAP METALS BY X-RAY ANALYSIS

FIELD OF THE INVENTION

This invention relates to a method and apparatus for the sorting of scrap material, and in particular it relates to a method and apparatus for sorting non-ferrous scrap material.

BACKGROUND TO THE INVENTION

There is a large amount of non-ferrous scrap generated each year and much of it comes from scrapped automobiles. Each year in North America there are approximately 10 million cars and small trucks scrapped by shredding. The cars or trucks are fed into shredders which are a type of large hammer mill, and the shredders smash a complete automobile into small pieces in seconds. After going through the shredder, a large proportion of the non-metallics, such as plastics, foam, carpeting, etc., is removed by air classification. Then steel, which is the main product of the shredder, is removed by magnetic means. This leaves some non-metals (which were not previously removed by the air classification) and some valuable non-ferrous metals such as aluminum, zinc, copper, brass, lead, plated zinc and brass, stainless steel, and perhaps some other non-ferrous metals.

The shredder product of non-ferrous metals is valuable but it is not easy to separate into its various components. One automobile may have of the order of 50 lb. of non-ferrous metal, depending on the make, model and year, and also depending on losses due to prior stripping. Remembering that about 10 million cars and small trucks are scrapped each year in North America, there would be about half a billion pounds of scrap non-ferrous metal produced each year. This material may have a value, at the present time, of about 15 cents per lb. when in an unseparated form, but perhaps about 30 cents per lb. when separated. Thus there is an available increase in value that could be attributed to satisfactory separation of the components of non-ferrous metal scrap of the order of $75 million per year.

In the past this non-ferrous metal scrap has been shipped from the shredders to processing plants which perform the separation. Some of these processing plants are abroad where labour is relatively cheap and the sorting is done by hand. However the majority of non-ferrous metal scrap is separated by a few processing plants which use a sequence of standard metallurgical separating techniques. For example, a first operation might be a heavy media operation which separates non-metals based on specific gravity. A typical media for this separation might be a magnetite material. A subsequent second operation might also be a heavy media operation using a ferrosilicon medium to separate aluminum. A third operation might involve a sweat furnace which separates zinc by a differential melting process. A fourth operation might be a separation by hand of copper bearing metals.

These separation processes remove only one component at a time and the processes must be sequential. It is difficult to accelerate or combine any of these separating processes. In addition, the equipment required is costly, and it is difficult to scale them down, so they cannot conveniently and economically be set up at each shredder. Rather, the scrap from each shredder is sent to a few central processing plants. However it would be desirable, from the standpoint of the shredder operator, to be able to separate the non-ferrous metal scrap at the shredder, and not only enhance the price but avoid the expense of shipping to a central processing plant.

There is another disadvantage connected with a sweat furnace which is used to melt zinc away from copper, brass, stainless steel, etc.. While copper, brass and stainless steel have much higher melting points, lead in the form of solder, balance weights and body filler has a melting point of the same order as zinc. Thus, lead is one of the main contaminents in the grade of zinc and a high lead content can greatly reduce the value of a zinc product.

Because of the desirability of being able to sort non-ferrous metal scrap without using complex metallurgical separation and also be able to do the sorting at the shredder, attempts have been made to sort non-ferrous scrap electronically. Canadian Pat. No. 1,110,996—CLARK et al, issued Oct. 20, 1981, describes a single-line feed type sorter for sorting non-ferrous auto scrap into multiple components. This sorter uses a circular rotating carousel onto which scrap pieces are deposited from a single line feed of scrap on a conveyor. The scrap pieces are moved by the carousel past a light unit which provides a signal representing the size of a piece of scrap, and then beneath a source of high energy radiation and an x-ray fluorescence detector which provides a signal indication of the kind of non-ferrous metal. The carousel floor which supports the scrap pieces comprises a plurality of radially extending keys. There are a plurality of chutes in sequential arrangement beneath the carousel. As a piece of scrap is carried by the carousel past a discharge chute for the particular kind of scrap, the respective keys are released to drop the piece of scrap down the proper chute.

Thus, the separation of the pieces is mechanical, which tends to limit the speed of sorting. Also, the feed is a single-line feed which also limits the speed. Because of the diameter of the carousel, it would be difficult to place several in a parallel arrangement for multiple single-line feed, and it would be difficult to have several conveyors, fed from a single bin, supply multiple carousels in parallel.

Another attempt was made in the late 1970's to adapt a random stream ore sorter to the sorting of non-ferrous auto scrap. A random stream re sorter is described in Canadian Pat. No. 923,601—KELLY et al, issued Mar. 27, 1973. Various illumination/detector combinations were tried including a colour TV camera for a single separation of copper bearing material from the rest of the non-ferrous scrap material. However, a reliable distinction could not be made between copper and pale yellow brass or between some varieties of red primer paint and copper oxide. Thus, while a random stream sorter has a desirably high sorting rate, the apparatus was not able to make a reliable separation of even a single component.

SUMMARY OF THE INVENTION

The present invention provides a sorter suitable for sorting non-ferrous scrap where the pieces of scrap are sorted in a substantially free fall, that is the pieces drop in a substantially vertical path. While this involves a slight complication in the tracking of accelerating pieces, it has considerable advantages over sorting horizontally moving pieces. For example, pieces which are gravity-accelerated will separate spatially which aids the detectors and the rejection means because they can function without errors caused by touching pieces. Vertically falling pieces are readily deflected by an air blast which is precise and rapid. By guiding the pieces with a slide plate, the underside of the near vertical stream is well defined and the detectors may be placed quite close to the pieces. This is not so with pieces supported on a horizontal belt or the like with the detectors spaced far enough above the pieces to avoid obstructing movement of the largest pieces. The throughput may be very much faster when pieces are falling under the influence of gravity. In addition it is not inconvenient to place multiple feed lines side by side to increase the sorting rate, or to use a random stream to increase it even more.

Thus, the present invention provides at least one stream of pieces which are moved horizontally and then discharged into a gravity accelerated trajectory which is substantially free fall. The falling pieces pass x-ray analysing apparatus which determines the component category to which each piece belongs. At successive intervals down the trajectory path, blast valves are used to deflect specific components from the stream at their particular designated zone. The blasted pieces are directed into individual transfer chutes which keep the component pieces separate for transfer to separate storage areas.

It is therefore an object of the invention to provide an improved method of sorting non-ferrous scrap material into a plurality of separate and distinct components as the pieces move once through the sorting apparatus.

It is another object of the invention to provide an improved sorting apparatus for sorting non-ferrous scrap material where the material moves through the apparatus along a substantially free fall path and separate components are detected and subsequentially deflected at successive intervals along the path into chutes for the particular component to provide a rapid and efficient sorting of multiple components.

It is yet another object of the invention to provide improved apparatus for the sorting of multiple different components along a free fall path with minimum disturbance between the deflection of the different components.

It is still another object of the invention to provide an improved apparatus for sorting of scrap material moving under the influence of gravity into multiple different components in adjacent parallel feeds from a common source.

Accordingly there is provided apparatus for sorting pieces of scrap metal into a plurality of components, each component being a specific metal type, comprising handling means for introducing pieces of scrap metal into the upper part of a sorting zone for movement therethrough under the influence of gravity along a predetermined path, first timing means at a first predetermined location along said predetermined path near the upper part of said sorting zone for providing first signals representing the time at which each piece passes said first predetermined location and the velocity at said first predetermined location, x-ray analysis means at a second location along said predetermined path below said first timing means for directing high energy rays at said pieces to induce x-ray fluorescence, determining from said x-ray fluorescence an indication for each piece of the metal type, and providing second signals representing this, at least a first and second fluid nozzle respectively at a third and fourth predetermined location along said predetermined path, said third predetermined location being below said second predetermined location and said fourth predetermined location being below said third predetermined location, each said nozzle having a respective control for fluid flow therethrough, each said nozzle being positioned adjacent said predetermined path to direct fluid across said path for deflecting a piece of scrap from said predetermined path along a respective first and second deflection path, and control means for receiving said first and second signals, determining pieces of scrap metal for deflection at a respective one of at least said third and fourth predetermined locations, determining the time at which a respective piece for deflection at said third location will pass said first nozzle and the time at which a respective piece for deflection at said fourth location will pass said second nozzle, and providing signals to the respective control for fluid flow to deflect pieces at said third and fourth locations along said respective first and second deflection paths.

BRIEF DESCRIPTION OF THE DRAWINGS

The invention will be described with reference to the accompanying drawings, in which.

DESCRIPTION OF THE PREFERRED EMBODIMENT

Figure 1:
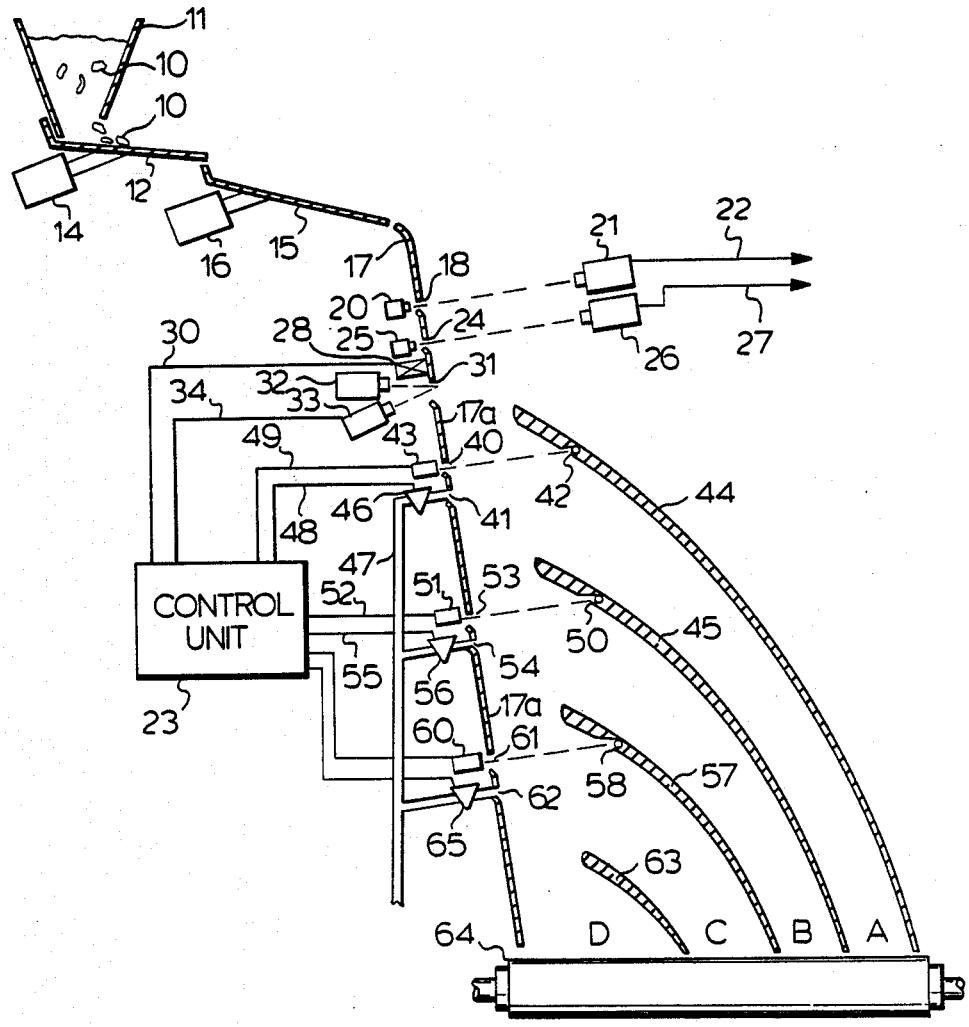
FIG. 1 is a schematic side elevation, partly in section, of sorting apparatus according to the invention.

Referring to FIG. 1, there is shown a sorting apparatus for sorting non-ferrous scrap . The pieces of scrap or particles of scrap are of varying size and shape as they would come from a shredder, but they are preferably screened scrap. In other words, the scrap is preferably screened to remove very large pieces and very small pieces. Approximately 90% of non-ferrous auto scrap derived from a shredder is between 3 inches and one half inch in size, or more simply $-3''$ to $+\frac{1}{2}''$. This size of scrap is conveniently sorted on two sorters, one designed for $-3''$ to $+1\frac{1}{2}''$ and one for $-1\frac{1}{2}''$ to $+\frac{1}{2}''$.

The pieces 10 are placed in bin 11 where they feed out at the bottom onto a pan 12 of a vibrating feeder driven by a motor 14. The pieces 10 move down pan 12 and fall off the edge of pan 12 onto pan 15 of a second vibrating feeder driven by a motor 16. Double stage feeders of this type are quite versatile. By changing the surface configuration of the pans and the slope of the pans and the velocities, a double stage or tandem feeder can provide a single layer, random stream feed, or a multiple (parallel) single line feed, or a simple single line feed. For example, a single layer, random stream feed is shown in Canadian Pat. No. 702,263—KELLY et al, issued Jan. 19, 1965. As another example, a feeder for multiple single lines is shown in Canadian Pat. No. 1,158,748—KELLY, issued Dec. 13, 1983. As yet another example, a feeder for a simple single line feed is shown in Canadian Pat. No. 1,073,408—KELLY, issued Mar. 11, 1980. The description will, for simplicity, be directed initially to a single line feed.

The pieces 10 move off the edge of pan 15, one at a time, onto a guide member or slide plate 17. At this point the pieces 10 are travelling at a uniform speed. As each piece 10 moves onto guide member 17, it begins to accelerate under the influence of gravity along the low friction surface of guide member 17. The guide member or slide plate 17 has a steep slope (about 80 degrees, after the initial portion), which permits the pieces to accelerate while providing a minimal guiding force to the pieces. The pieces are virtually free-falling.

As the pieces move down guide member 17 they pass a window or translucent portion 18 in guide member 17. A light source 20 is behind the window and photodetector 21 is opposite the light source 20. The passage of a piece of scrap 10 past the window 18 occults the light received by the photodetector 21, and photodetector 21 provides a signal on conductor 22 representing the passage of a piece of scrap. The signal on conductor 22 is connected to a control unit 23 and provides to control unit 23 a timing signal. Similarly, a second window or translucent portion 24 has a light source 25 behind it and a photodetector 26 opposite the light source 25. A piece of scrap 10 occults the light received by photodetector 26 when the piece of scrap 10 passes window 24 and photodetector 26 provides a signal on conductor 27. Conductor 27 is also connected to control unit 23. Because windows 18 and 24 are a known distance apart, control unit 23 is able to use the time represented by the signals on conductors 22 and 27 to determine the instantaneous velocity at window 24. From this the further path, velocity and timing can be forecast. Photodetector 26 also provides information which, when corrected for acceleration, provides a value representing length and area. A value representing length is derived from the time a piece starts to occult light until the piece passes and stops occulting light. A value representing area is obtained from the amount of light a piece occults in passing.

As a piece of scrap continues to fall down guide member or slide plate 17 it passes a metal detector 28 which provides a signal on conductor 30 to control unit 23. The signal represents the passage of any kind of metal. Such metal detectors are known. Immediately below metal detector 28 is a window 31. A source 32 of high energy radiation is positioned behind window 31 together with an energy-dispersive detector 33. The source 32 may be an x-ray tube source, or it may be a radioisotope source which induces x-ray fluorescence. The energy-dispersive detector 33 may be a proportional counter or a cooled Si(Li) detector. Suitable sources and detectors are known in the field of x-ray fluorescence, and they may be obtained from EG&G Canada Ltd., Markham, Ontario, Canada, and Kevex Corporation, Foster City, Calif., U.S.A., as well as others. The use of x-ray sources and detectors are described in the aforementioned Canadian Pat. No. 1,110,996—CLARK et al.

The energy-dispersive detector 33 provides a signal on conductor 34 representative of the fluorescence detected which is, in turn, representative of a specific metal type or component. Control unit 23 receives this signal and now has the required information on each piece of scrap for sorting. Control unit 23 has signals representing the following information:

(a) size, shape and position
(b) velocity
(c) metal or non-metal
(d) classification of the metal
(e) the sorting category (derived from the metal classification)
(f) timing information All the above information has been obtained in a small part of the trajectory near the start, for example in the first 12 inches or so of free fall. The remainder of the slide plate or guide, that is the part below window 31, may be a straight guide member at an angle to the horizontal of about −80 degrees. The relatively steep angle ensures that the pieces slide down the surface with minimal frictional retardation while being guided by the surface. This portion of the slide plate or guide is preferably in the form of a grating, and is given the designation **17*a* to distinguish it from the upper slide plate portion 17 which may be either a plate or a grating. A suitable form of slide plate 17*a* will be described with reference to FIGS. 2 and 3**.

Figure 2:
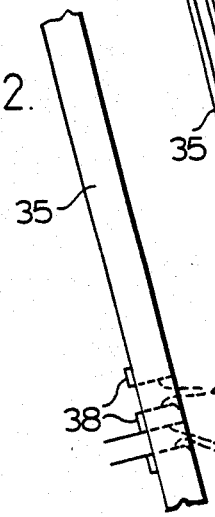
FIGS. 2 and 3 are a side view and a front view of the lower portion of a slide plate according to one form of the invention.
Figure 3:
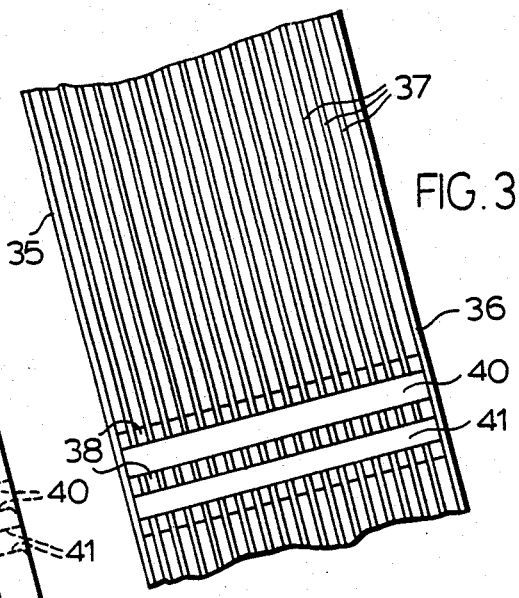

Referring to FIGS. 2 and 3, there is shown a side view and a front view of a portion of slide plate **17*a*. The slide plate 17*a* has two side members 35 and 36 with longitudinal members 37 spaced evenly therebetween. The members 37 may, for example, be strips of metal having a thickness of 1/16 inch and a width of ½ inch, spaced apart on ¼ inch centres to form a grating. Cross members 38 at intervals, as required, support the members 37 from side members 35 and 36. There are shown two openings or windows 40 and 41. The window 41 receives the nozzle of a blast deflection system as will be described hereinafter. The corners of members 37 where the members end just below each window, as indicated in windows 40 and 41** are rounded. This is to avoid the possibility of a piece of scrap hitting a sharp corner.

The slide plate **17*a*** is preferably in the form of a grating, as shown, in order to quickly dissipate any pressure wave developed when objects are deflected by an air blast. In the past, when sorting objects such as pieces of ore, a solid slide plate was used. When a blast of air was directed at a particle or piece of ore to deflect it, a pressure wave was created which affected the velocity and trajectory of adjacent particles. This may cause an incorrect timing of an air blast or may result in improper deflection. This is believed to have caused unexplained errors of a few percent on high tonnage ore sorting. This was discovered by slow motion video analysis. The solid slide plate used in all free fall sorters, as far as is known, contributed to the effect by guiding the diverted air blast into the path of the following objects being sorted. The use of a grating type slide plate permits diverted air to escape and substantially eliminates the problem. It will be apparent, however, that other forms, sizes or arrangements of grating could be used.

Referring again to FIG. 1, the control unit 23 has the information to deflect the different components. Timing is more critical in this sorter than in prior art free-fall type sorters because of the considerably greater length a piece must fall before the final component is sorted. The use of a grating for slide plate **17*a*** greatly reduces timing errors, but errors in sorting are extremely important in the sorting of different components. It will be realized that when sorting ore, the sorting is based on the grade of a particular ore. Each piece is an acceptable piece of that ore or it is not acceptable. If there are a few errors in the sorting, then the grade of the sorted ore will be affected to some extent. But when sorting multiple different non-ferrous scrap pieces, if a piece is sorted incorrectly and goes into a storage bin for a different metal, it is a contaminant for that metal. That is, it does not affect the concentration only, as would an error in sorting ore, it is a contaminant that may greatly reduce the price of the sorted metal. Consequently it is desirable to ensure the timing is accurate.

Thus, there is provided a pair comprising a photoemitter and a photodetector for each component to be sorted. A photoemitter 42 and a photodetector 43 are positioned on either side of the path of the pieces. The photodetector 43 is positioned just behind window 40 and receives light from photoemitter 42 which is mounted on the under surface of splitter plate 44. Preferably the photoemitter 42 and photodetector 43 are small solid state devices. Photoemitter 42 is preferably mounted in splitter plate 44 so that it is protected from pieces that are deflected by an air blast. Photodetector 43 provides a signal on conductor 49 to control unit 23 when a piece of scrap passes window 40.

An air blast nozzle is mounted in or forms part of window 41. The nozzle directs a blast of air across the path of falling pieces to deflect particular pieces into the path for first component pieces between splitter plate 44 and adjacent splitter plate 45. The air blast through window 41 is turned on and off by a blast valve 46 which is connected by pipe 47 to a source of air under pressure (not shown). The blast valve 46 is controlled by a signal on conductor 48 from control unit 23.

Similarly a photoemitter 50 and a photodetector 51 are on opposite sides of the path of the falling pieces and the photodetector 51 detects the passage of a piece and provides a signal on conductor 52 to control unit 23. Photodetector 51 is behind a window 53 and photoemitter 50 is mounted on the underside of splitter plate 45. Just below window 53 is a window 54 in which an air blast nozzle is mounted (or the nozzle may be part of window 54). An air blast through the nozzle of window 54 is controlled by a blast valve 56 which is connected to a pipe 47 which carries a supply of air under pressure. A signal from control unit 23 on conductor 55 opens and closes blast valve 56 as required to deflect a component piece of metal into a path defined between splitter plate 45 and a splitter plate 57.

Another set of similar parts comprising photoemitter 58 mounted in splitter plate 57, photodetector 60 behind window 61, air blast nozzle in window 62, and blast valve 65 cooperate to deflect pieces of a particular component into a path between splitter plates 57 and 63. As these are similar to preceding sets of parts, it is believed no further description is necessary.

Pieces which are not deflected will fall along guide member 17*a* onto a roller driven belt 64. The belt 64 carries three sorted component pieces, and a remainder, to suitable storage bins or the like. It will be apparent that more stages for sorting additional components may be added.

It should be noted that the timing signals obtained from photodetectors 21 and 26 do not time the operation of air blast valves 46, 56, and 65. The timing signals obtained from photodetectors 21 and 26 are enabling signals for each respective valve when the analysing determines the piece is a component metal, i.e. a category of metal scrap that is to be deflected at that stage of the trajectory. The enabling signal is provided with sufficient timing leeway to cover minor possible variations. The actual timing signal for an air blast valve is derived from the signal of the photodetector preceding the valve.

While the preferred way of obtaining the timing of the air blast to deflect a piece is as described, that is with photodetectors 21 and 26 providing an enabling signal and the photodetectors 43, 51 or 60 providing an exact timing signal, it is possible to operate with the timing signal from photodetectors 21 and 26 providing the actual operating signal to the blast valves. This would require an overblast (i.e. a longer blast) to ensure the piece was deflected. This increases the amount of 45 and a splitter plate 57. air used which increases the cost of sorting.

It is believed the operation of the sorter will be clear, however a brief description is given to ensure a proper understanding of the invention. Let us assume there are four pieces represented by A,B,C and D moving down pan 15 onto guide member or slide plate 17. Each piece is a piece of a different scrap metal. The pieces fall in sequence past windows 18 and 24, and timing signals are carried by conductors 22 and 27 to control unit 23. From these signals control unit 23 determines size (average width and length), velocity, and initial time. Pieces A,B,C and D fall past metal detector 28 and control unit 23 receives a signal on conductor 30 indicating which of A,B,C and D are metals. Suppose A,B and C are three different metals and D is a non-metal and that non-metals are not to be deflected.

Pieces A,B,C and D fall past window 31 where x-ray source 32 directs a beam of high energy at them to induce x-ray fluorescence. The energy-dispersive detector 33 detects the fluorescence associated with each piece of scrap A,B,C and D and provides a signal on conductor 34 to control unit 23. The signal on conductor 34 represents a specific component, that is a specific metal type for pieces A, B and C. Suppose piece A is a component or metal type to be deflected by the air blast at window 41 into the deflection path between splitter plates 44 and 45. Control unit 23 determines from the signals provided on conductors 22 and 27 when piece A should be opposite window 41 and provides an enabling signal. As piece A occults the light received by photodetector 43, a specific timing signal is provided on conductor 49 representing an initiation time for the air blast and a termination time for the air blast, which will be the time when piece A is in front of window 41. The specific timing signal occurs during the enabling signal and control unit 23 provides a signal on 48 which opens and closes the control, i.e. the blast valve 46, at the required times to deflect piece A into the deflection path between splitter plates 44 and 45. Piece A falls onto belt 64 between splitter plates 44 and 45 with other pieces of like metal type.

Similarly piece B is deflected as it passes the blast nozzle in window 54 into the deflection path between splitter plates 45 and 57, and piece C is deflected as it passes the blast nozzle in window 62 into the deflection path between splitter plates 57 and 63. Piece D is not deflected and falls down slide plate 17*a* onto belt 64 between member 17*a* and splitter plate 63. Thus belt 64 has four separate components deposited on it at different parts representing three different metal types and a non-metal. Belt 64 carries the different components to different storage areas.

It is believed the operation of the sorting apparatus in its different forms will be clear. There is no theoretical limit to the number of components that can be sorted if they can be distinguished. In practice, when sorting auto scrap, there are perhaps seven or eight components of sufficient value to separate. The deflection nozzles can be positioned of the order of one foot apart for at least the first several deflection points, and allowing two feet for the initial timing and analysis would result in a total vertical space for the sorting zone of the order of 12 feet.

Figure 4:
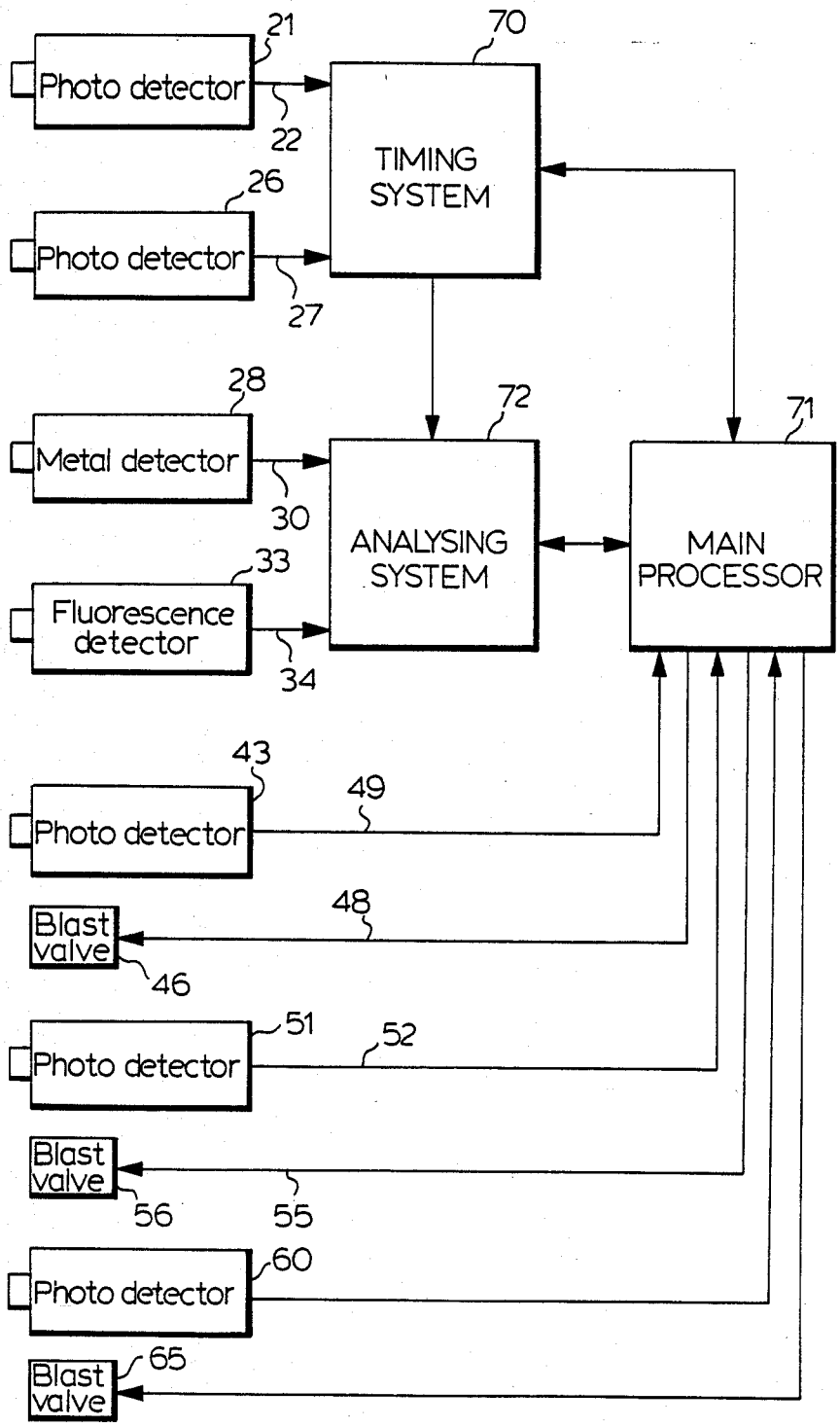
FIG. 4 is a schematic block diagram of circuitry suitable for use in one form of the invention.

The control unit 23 of FIG. 4 was described as having certain functions. These functions may be implemented in a variety of ways, but it is probably most convenient to make use of one or more micro-computers to process the data from the photodetectors, the metal analysing elements, and to operate the blast valves. Only a general description will be given, as similar types of sorting electronics systems have been detailed in previous patents, such as Canadian Pat. No. 1,158,748—Kelly, issued Dec. 13, 1983.

FIG. 4 shows the organization in block diagram form of the electronics of control unit 23 for a single line sorter. Photodetectors 21 and 26 output signals to timing system 70 which may be a separate micro-computer. Timing system 70 processes the data and assigns all the timing-related information for each piece of scrap to a specific block of memory in main processor 71. From the raw timing and width signals input by photodetectors 21 and 26, timing system 70 derives timing, velocity, length/width and position information which is used to forecast the time of transit past metal detector 28 and energy-dispersive x-ray fluorescence detector 33, to furnish width/size information to these detectors, and to forecast the approximate time past the various blast valves, for use as an enabling signal. Use of solid state scanners for photodetectors 21 and 26 is preferred, as the output is fine resolution, accurately timed, and already in digitized form, suitable for input directly to a micro-computer. Such scanners are available commercially from EG&G Reticon, Sunnyvale, Calif.

Metal detector 28 and energy-dispersive x-ray fluorescence detector 33 output signals to analysing system 72, which also receives timing and size information from timing system 70. The metal detector 28 output is analysed by analysing system 72 during transit time of the particle to establish if it is metal or non-metal. This is necessary to distinguish between plastics and aluminum, neither of which produce x-ray fluorescence which is detectable in a sorting environment, because their characteristic energies are too low to travel through air and penetrate the detector window.

The output of energy-dispersive x-ray fluorescence detector 33 is also processed in analysing system 72. This task of processing the emitted spectrum has been the subject of intense study and development since energy-dispersive detectors were first developed in 1968. A representative general text, Quantitative X-ray Spectrometry, by Jenkins, Gould, Gedcke, published by Dekker, 1981, describes the main methods used to derive quantitative analytical information from the complex spectrum which arises in energy-dispersive x-ray systems. Almost all makers of this equipment can supply computers and programs which process the data and make a rapid identification of alloys and metals, since this is one of the main uses of energy-dispersive x-ray fluorescence instruments. Normal programs in such instruments are usually run either for a predetermined time, or until a predetermined statistical accuracy is reached, but analysing system 72 includes a modification of such a standard identification program, wherein a decision is called for at the end of a variable time interval determined by the transit of the piece. Information on the size of the piece is also made available to analysing system 72 from timing system 70, because count rates under the peaks, background and scatter are to some extent dependent on the area of the particle 'seen' by the detector. The decision on the metal type of each piece is passed on from analysing system 72 to main processor 71.

Main processor 71 thus has in memory for each piece in the system its identification and hence the particular blast valve which must be enabled. It also has the information on the expected time of transit past that particular valve, and this is translated into an enabling signal with sufficient leeway to cover any errors in the actual transit time past that valve compared with the forecast time. Photodetectors 43, 51 and 60 are routed to processor 71 and serve to precisely time blast valve controls 46,56 and 65 respectively whenever an enabling signal is present for that particular valve.

Figure 5:
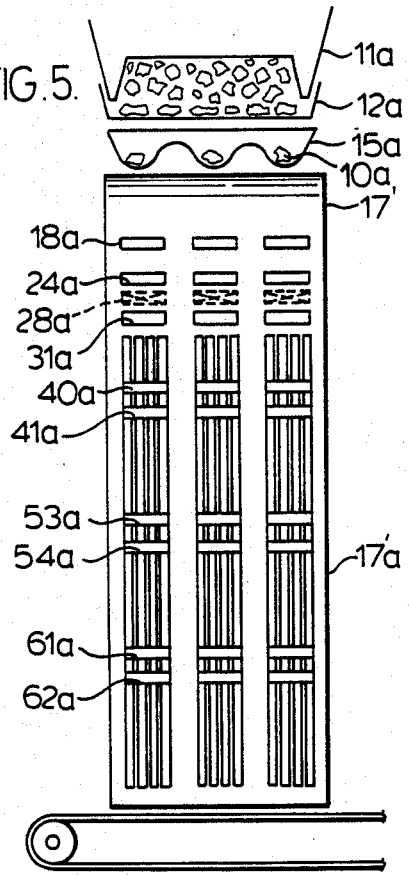
FIG. 5 is a front view of a sorting apparatus for sorting multiple parallel lines of scrap.

The FIG. 4 circuitry just described relates to sorting of pieces of scrap falling in a single line. The same circuitry could be used for sorting multiple parallel lines of scrap. Referring briefly to FIG. 5, there is shown a front view of apparatus for sorting three parallel lines. The feeder, which comprises bin 11*a*, pan 12*a* and formed pan 15*a*, is generally of the type described in aforementioned Canadian Pat. No. 1,158,748. The pieces 10*a* drop off the pan 15*a* in three lines and slide down slide plate or guide member 17′ and 17′a. There are three sets of everything. As indicated in the left hand line by the same designation numbers as in FIG. 1 followed by a suffix "a", the apparatus is similar and operates in a similar manner. In practice it is more economical, depending on the number of parallel lines used, to share some functions. For example, a solid state scanner, i.e. photodetector, extending across all lines may be used and its output appropriately divided. There may, of course, be more than three parallel lines of scrap sorted.

Figure 6:
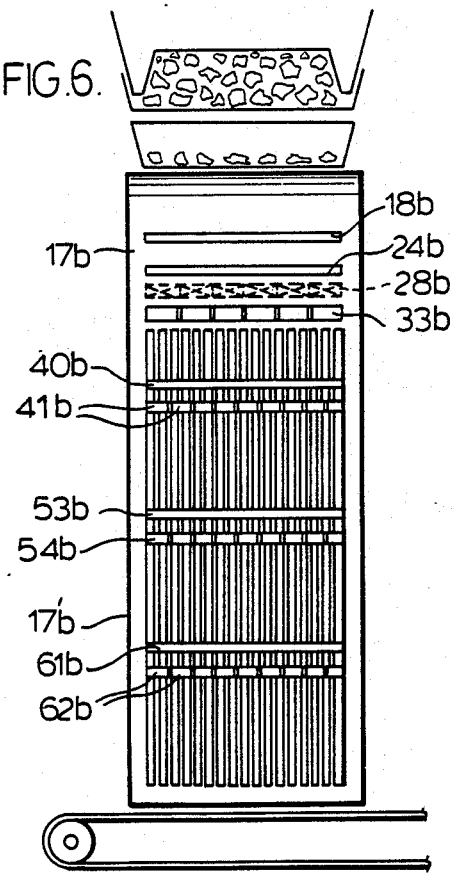
FIG. 6 is a front view of a sorting apparatus for sorting a random stream of pieces of scrap metal

Referring briefly to FIG. 6, there is shown a front view of apparatus for sorting pieces of scrap moving through the sorting zone in a random stream. Apparatus for sorting a random stream of objects is more complex than sorting objects in multiple parallel lines as is explained in the aforementioned Canadian Pat. No. 702,263. This is because there is a memory means for storing the transverse position and width of each object so that all the data related to an object is associated with that object. Canadian Pat. No. 897,800—Kelly et al, issued Apr. 11, 1972 describes a system for retaining data related to objects moving in a random stream.

There are some modifications required in an apparatus for sorting scrap in a random stream. High resolution scanners may be used to replace photodetectors 21 and 26 of FIG. 1, and they are able to map the flow of pieces of scrap across the width of the stream of pieces as they pass windows 18*b* and 24*b*. However it is not presently possible to use metal detectors and energy dispersive detectors which scan rapidly. Consequently metal detectors 28*b* and energy dispersive detectors 33*b* are a closely spaced array of individual detectors extending across the width of the sorting stream. The accuracy of the sorting of scrap material depends on detecting as many x-ray counts as possible in the short time a piece of scrap passes the detector, because the counts fluctuate statistically obeying the Poisson distribution. Any attempt to scan would decrease accuracy because the act of scanning implies a division of scan time between adjacent segments, and the higher the resolution the shorter is the time allotted to each segment.

It is important to select a suitable number of detectors 33*b* and a suitable number of blast nozzles 41*b*, 54*b* and 62*b* which extend across the stream of pieces. One way of doing this is by slow motion video analysis of a stream of pieces of scrap of the same size and type that will be sorted. Too narrow a detector sees or detects only a small section of a piece and this yields only a small number of counts. On the other hand, too wide a detector makes it possible for two pieces side by side to be seen as one piece by a detector and they will give interfering counts.

The number of blast valves and nozzles which extend across the width of the stream need not be the same as the number of detectors. Generally speaking, it is desirable to have a greater number of blast nozzles than detectors, rather than less, to reduce the chance of a blast affecting adjacent pieces.

The operation of the random stream embodiment of FIG. 6 is similar to the previously described embodiments except that in the memory there must be provision to store the lateral position of each piece as it moves through the sorting zone, and if a piece is to be deflected, to enable the appropriate blast valves. This is a task which is suitable for a micro-computer, and which may utilize the general procedure described in aforementioned Canadian Pat. No. 897,800.

It is believed that the preceding description provides a complete understanding of the invention.

I claim:

1. Apparatus for sorting pieces of scarp metal into a plurality of components, each component being a specific metal type, comprising:

handling means for introducing pieces of scrap metal into the upper part of a sorting zone for movement therethrough under the influence of gravity along a predetermined path, first timing means at a first predetermined location along said predetermined path near the upper part of said sorting zone for providing first signals representing the time at which each piece passes said first predetermined location and the velocity at said first predetermined location, x-ray analysis means at a second location along said predetermined path below said first timing means for directing high energy rays at said pieces to induce x-ray fluorescence, determining from x-ray fluorescence an indication for each piece of the metal type, and providing second signals representing this, at least a first and second fluid nozzle respectively at a third and fourth predetermined location along said predetermined path, said third predetermined location being below said second predetermined location and said fourth predetermined location being below said third predetermined location, each said nozzle having a respective control for fluid flow therethrough, each said nozzle being positioned adjacent said predetermined path to direct fluid across said path for deflecting a piece of scrap from said predetermined path along a respective first and second deflection path, said guide member at least in the regions adjacent said first and second nozzles being a grating having closely spaced longitudinal members to provide a guiding surface and spaces therebetween to permit air used to deflect a piece from the predetermined path to escape from the sorting zone, and control means for receiving said first and second signals, determining pieces of scrap metal for deflection at a respective one of at least said third and fourth predetermined locations, determining the time at which a respective piece for deflection at said third location will pass said first nozzle and the time at which a respective piece for deflection at said fourth location will pass said second nozzle, and providing signals to the respective control for fluid flow to deflect pieces at said third and fourth locations along said respective first and second deflection paths.

2. Apparatus according to claim 1 in which said first timing means comprises a first and second light source spaced apart along said path and a first and second photodetector on the opposite side of said path from the respective first and second light source, said pieces passing between said light sources and photodetectors to occult the light striking the photodetectors, said first timing means also determining the length of each piece for providing a signal representing the length of time a control for fluid flow should be activated to direct fluid onto a passing piece for the time the piece passes in front of the respective nozzle.

3. Apparatus according to claim 2 in which the fluid is air.

4. Apparatus for sorting pieces of non-ferrous scrap metal as they move through a generally vertically disposed sorting one along a predetermined path under the influence of gravity, comprising handling means for introducing pieces of scrap metal into the upper part of said sorting zone for movement therethrough in a single line down an inclined guide member under the influence of gravity, a first and a second light source and photodetector, said first light source and first photodetector being positioned on opposite sides of said predetermined path near the upper end of said guide member, said second light source and second photodetector being positioned on opposite sides of said predetermined path below said first light source and first photodetector, said first and second photodetectors providing first and second signals as each piece of metal occults the light received by the respective photodetector, x-ray analysis means adjacent said predetermined path below said second light source and second photodetector for directing high energy radiation onto said pieces as they move down said guide member to induce x-ray fluorescence in said pieces, and for detecting said fluorescence indicating a metal type for each said piece and providing third signals representing this, at least a first and a second air directing nozzle at respective openings in said guide member for directing air through the respective opening at particular pieces of scrap to deflect them from said predetermined path, said first nozzle being below said x-ray analysis means and said second nozzle being below said first nozzle, said first and second nozzles being provided with a respective control for air flow therethrough, and at least portions of said guide member adjacent said first and second nozzles being in the form of a grating to permit air issuing from a nozzle and diverted by a piece of scrap to escape through said grating, and control means for receiving said first, second and third signals, determining for each piece its metal type and designating it for deflection by said first nozzle, said second nozzle or for no deflection and providing signals to said control for air flow through said first and second nozzle to initiate and terminate air flow therethrough as a piece designated for deflection passes the respective nozzle to deflect said piece to a respective first and second deflection path.

5. Apparatus for sorting pieces of non-ferrous scrap metal into a plurality of components as the pieces move through a generally vertically disposed sorting zone along a predetermined path under the influence of gravity, comprising, handling means for introducing pieces of scrap metal into the upper part of said sorting zone for movement therethrough down an inclined guide member under the influence of gravity in a plurality of adjacent parallel lines, a first and second light source and a first and second photodetector each extending substantially across said predetermined path, said first light source and first photodetector being positioned on opposite sides of said predetermined path near the upper end of said guide member, said second light source and second photodetector being positioned on opposite sides of said predetermined path spaced below said first light source and first photodetector, said first and second photodetectors providing first and second signals representing the time at which each piece occults the light and its transverse position, x-ray analysis means adjacent said predetermined path below said second light source and photodetector for directing high energy radiation across said path and onto said pieces as they move down said guide member to induce x-ray fluorescence in said pieces, and for detecting said fluorescence and indicating a metal type for each piece, and providing third signals representing this, at least a first and second set of air directing nozzles at respective opening in said guide member extending across said guide member for directing air through said respective openings to deflect particular pieces from said predetermined path, said first set of nozzles being spaced below said x-ray analysis means and said second set of nozzles being spaced below said first set of nozzles, each nozzle having a control for air flow therethrough, at least portions of said guide member adjacent said openings for said first and second set of nozzles being in the form of a grating, to permit air issuing from said nozzles and diverted by a pieces of scrap being deflected, to escape through the grating, and control means for receiving said first, second and third signals, determining for each piece its metal type and transverse position and designating it for deflection by nozzles in said first set of nozzles, by nozzles in said second set of nozzles, or for no deflection by said first and second set of nozzles, and providing fourth signals to respective ones of said controls for air flow through said first and second sets of nozzles to initiate and terminate air flow for deflection of respective designated pieces to respective first and second deflection paths.

6. Apparatus according to claim 5 in which the grating is in the form of longitudinally extending strips.

7. Apparatus for sorting pieces of non-ferrous scrap metal as they move through a generally vertically disposed sorting zone along a predetermined path under the influence of gravity comprising, handing means for introducing pieces of scrap metal into the upper part of said sorting zone for movement therethrough in a single line down an inclined guide member under the influence of gravity, a first and a second light source and photodetector, said first light source and first photodetector being positioned on opposite sides of said predetermined path near the upper end of said guide member, said second light source and second photodetector being positioned on opposite sides of said predetermined path below said first light source and first photodetector, said first and second photodetectors providing first and second signals as each piece of metal occults the light received by the respective photodetector, x-ray analysis means adjacent said predetermined path below said second light source and second photodetector for directing high energy radiation onto said pieces as they move down said guide member to induce x-ray fluorescence in said pieces, and for detecting said fluorescence indicating a metal type for each said piece an providing third signals representing this, at least a first and a second air directing nozzle at respective openings in said guide member for directing air through the respective opening at particular pieces of scrap to deflect them from said predetermined path, said first nozzle being below said x-ray analysis means and said second nozzle being below said first nozzle, said first and second nozzles being provided with a respective control for air flow therethrough, control means for receiving said first, second and third signals, determining for each piece its metal type and designating it for deflection by said first nozzle, said second nozzle or for no deflection and providing signals to said control for air flow through said first and second nozzles to initiate and terminate air flow therethrough as a pieces designated for deflection passes the respective nozzle to deflect said piece to a respective first and second deflection path, and a first additional photodetector and a photoemitter spaced apart on opposite sides of said predetermined path and spaced above said first nozzle, said first additional photodetector providing a timing signal for control for air flow through said first nozzle, and wherein said signal for timing derived from said first and second signals is an enabling signal permitting actuation of said control for air flow through said first nozzle by said timing signal from said first additional photodetector.

8. Apparatus according to claim 1 and further comprising a second additional photodetector and a second photoemitter spaced apart on opposite sides of said predetermined path and spaced above said second nozzle and below said first nozzle, said second additional photodetector providing a timing signal for control of air flow through said second nozzle, and wherein the signal for timing derived from said first and second signals is an enabling signal permitting actuation of said control for air flow through said second nozzle by said timing signal from said second additional photodetector.

* * * * *